US006138814A

United States Patent [19]

Miller et al.

[11] Patent Number: 6,138,814

[45] Date of Patent: Oct. 31, 2000

[54] FRONT LOADING CASH BOX ASSEMBLY

[75] Inventors: Charles R. Miller, Henderson; Darren W. White; John W. Burnside, both of Las Vegas, all of Nev.

[73] Assignee: Sigma Game, Inc., Las Vegas, Nev.

[21] Appl. No.: 09/099,712

[22] Filed: Jun. 19, 1998

[51] Int. Cl.[7] ..... G07F 7/04

[52] U.S. Cl. ..... 194/350; 902/11

[58] Field of Search ..... 194/206, 350; 232/15, 16, 7, 12; 902/11, 13, 12

[56] References Cited

U.S. PATENT DOCUMENTS

| | | | |
|---|---|---|---|
| D. 344,296 | 2/1994 | McKay et al. | D21/37 |
| 849,306 | 4/1907 | Wood | 232/7 |
| 5,129,330 | 7/1992 | McKay et al. | 109/59 R |
| 5,676,231 | 10/1997 | Legras et al. | 194/206 |
| 5,700,195 | 12/1997 | Halic | 194/206 X |

*Primary Examiner*—F. J. Bartuska

*Attorney, Agent, or Firm*—Skjerven Morrill MacPherson LLP; Brian D. Ogonowsky

[57] ABSTRACT

A cash box assembly particularly suited for a slant-top slot machine is described. The slant-top slot machine has an angled console, incorporating the display area and the user interface. The present invention allows an attendant to easily remove a cash box from the console area of a slant-top gaming machine while the attendant stands upright in a comfortable position. The cash box is accessed through a door in the console. The cash box is located at the rear of an arcuate chute so that, when the attendant grasps the handle and pulls the cash box forward, the cash box slides upward along the arcuate path. At the point where the cash box is exiting the arcuate chute, the front of the cash box is approximately parallel to the slanted plane of the console. This is an optimal angle for removing or inserting the cash box. The arcuate path not only reduces the necessary size of the console opening to gain access to the cash box assembly, but provides a more ergonomic cash box removal and insertion technique.

11 Claims, 10 Drawing Sheets

FRONT LOADING CASH BOX ASSEMBLY

FIELD OF THE INVENTION

This invention relates to cash box assemblies used in coin or bill-operated machines and, in particular, to a front-loading cash box assembly particularly suited for a slant-top gaming machine.

BACKGROUND

Modern gaming machines found in casinos accept bills, as well as coins, for playing the machine and direct the bills into a cash box inside the machine. Since the preferred embodiment of the present invention relates to a cash box for bills only, the background regarding this type of cash box and extraction method will be described. In prior art machines, bills are automatically stacked within the cash box. At certain times, an attendant uses a key to open a door in the gaming machine to gain access to the cash box. The attendant then removes the cash box from the machine, and an empty cash box is then inserted into the gaming machine.

One such cash box is described in U.S. Pat. No. 5,129,330, entitled "Currency Security Box," by Linn McKay and Frank DeSimone, assigned to the present assignee and incorporated herein by reference.

Access to the cash box is typically either from the side of the machine or from the front of the machine. For low gaming machines, such as slant-top machines at which the player sits on a stool, pulling the cash box out of the machine frequently requires the attendant to bend over, which becomes very tiresome after this act has been performed many times. Typically, the cash box is pulled straight out from the machine in a horizontal direction.

What is needed is a cash box assembly which is particularly suited for modern gaming machines and where the cash box is more easily removed from and inserted into the gaming machine.

SUMMARY

A cash box assembly particularly suited for a slant-top slot machine is described. The slant-top slot machine has an angled console, incorporating the display area and the user interface, in contrast to a conventional upright slot machine. The cabinet is typically designed so that the player may sit comfortably while playing the machine. As a result, the player console is relatively low.

The present invention allows an attendant to easily remove a cash box from the console area of a slant-top gaming machine while the attendant stands upright in a comfortable position. The attendant can view the cash box during the entire process, obviating the need for the attendant to feel around for the cash box handle.

In one embodiment of the invention, the slanted console has a hinged door which is unlocked and raised to reveal a bill validator and cash box assembly. The bill validator is located above the cash box and forwards a bill through a slot in the top of the cash box. A mechanism in the cash box, which is driven by external gears in contact with the cash box, positions the bill on a stack of other bills in the cash box. After a time, the cash box will become relatively full and will need to be removed and replaced with an empty cash box.

Once the console door is opened, an inner locked door, as part of the cash box assembly, blocks access to the cash box. The inner locked door is then opened with a key. After the inner locked door is opened, the attendant reaches through the opening and grasps the handle of the cash box. The cash box is located at the rear of an arcuate chute so that, when the attendant grasps the handle and pulls the cash box forward, the cash box slides upward along the arcuate path. At the point where the cash box is exiting the arcuate chute, the front of the cash box is approximately parallel to the slanted plane of the console. This is an optimal angle for removing or inserting the cash box. The arcuate path not only reduces the necessary size of the console opening to gain access to the cash box assembly, but provides a more ergonomic cash box removal and insertion technique.

To reinsert an empty cash box, the cash box is pushed while automatically guided along the arcuate path until stopped by the back of the assembly. The cash box is then automatically locked into position with a spring lock, and the attendant then locks the inner door. A gap between the top of the inner locked door and the bill validator allows the attendant to see and reach the handle of the cash box, if necessary for adjusting the position of the cash box, while the attendant is standing in an upright position. The attendant then closes the console door and locks it.

This technique of removing and replacing a cash box is generally applicable to any money-operated device. The convenience of front loading combined with the ergonomic design is especially suited for slant-top gaming machines in a casino.

DETAILED DESCRIPTION

Figure 1:
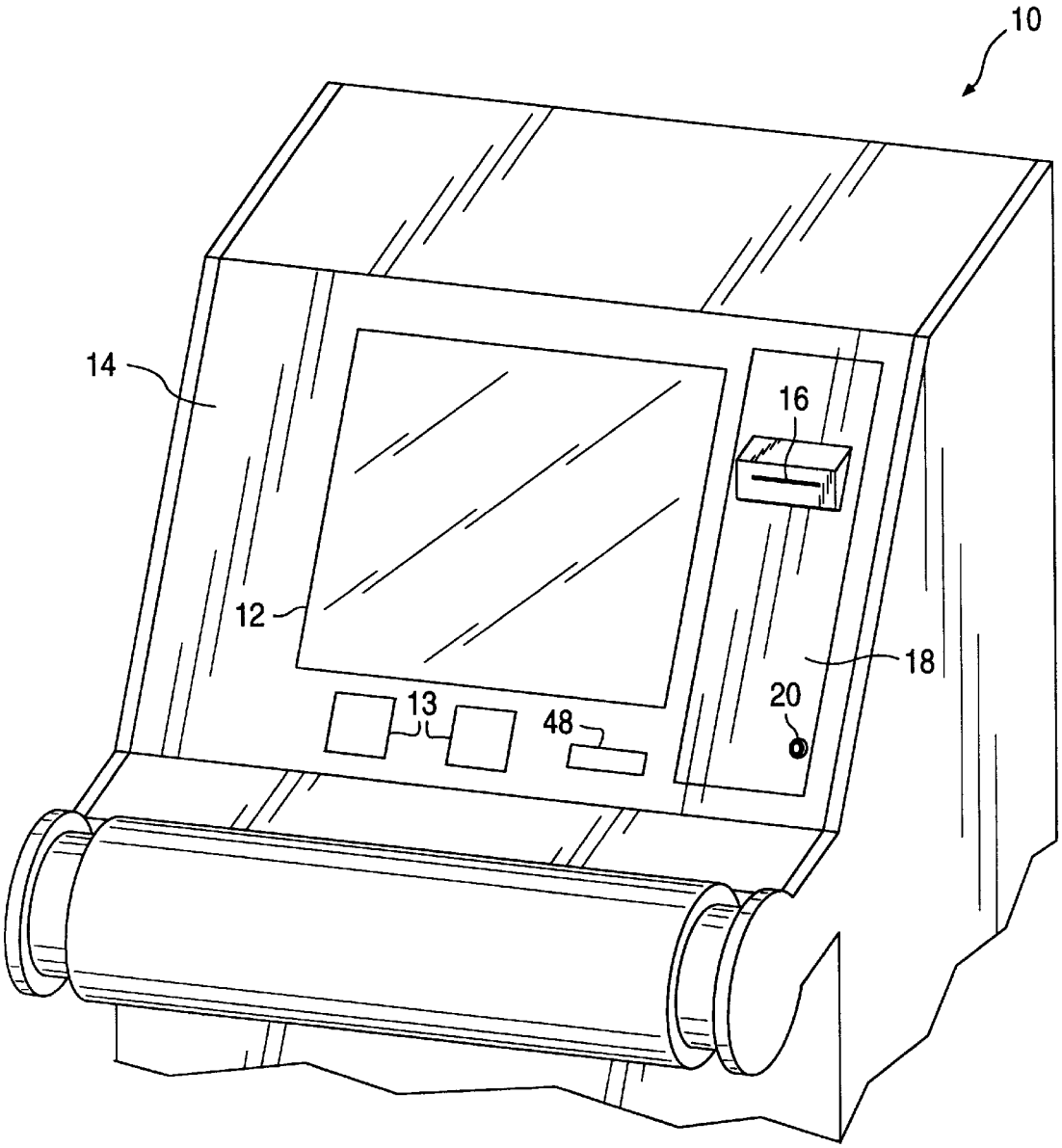
FIG. 1 illustrates a slant-top gaming machine with the console door in the locked position.

FIG. 1 is a perspective view of a slant-top gaming machine 10, which may be of conventional design except for the cash box assembly portion. Machine 10 may include a video display or a window 12 through which rotating reels are viewed. Player-activated switches (shown generally as switches 13) are incorporated into the slanted console 14 to enable the player to operate the machine 10. Such gaming machines are well known and will not be described in detail. Greater detail of a slant-top machine is shown in U.S. Pat. No. Des. 344,296, assigned to the present assignee and incorporated herein by reference. The slanted console is low enough so that a player sitting at the machine has all the user interface controls comfortably within reach.

A bill validator opening 16 accepts bills of various denominations. The bill validator may be conventional. The bill validator contains rollers and belts which forward the bill into an optical viewing area for validating the bill. After the bill is validated, the bill is forwarded to a cash box, to be discussed in detail below. Suitable bill validators include a model WBA by JCM, Inc. or a model ZT100 by Mars Electronics International.

Figure 2:
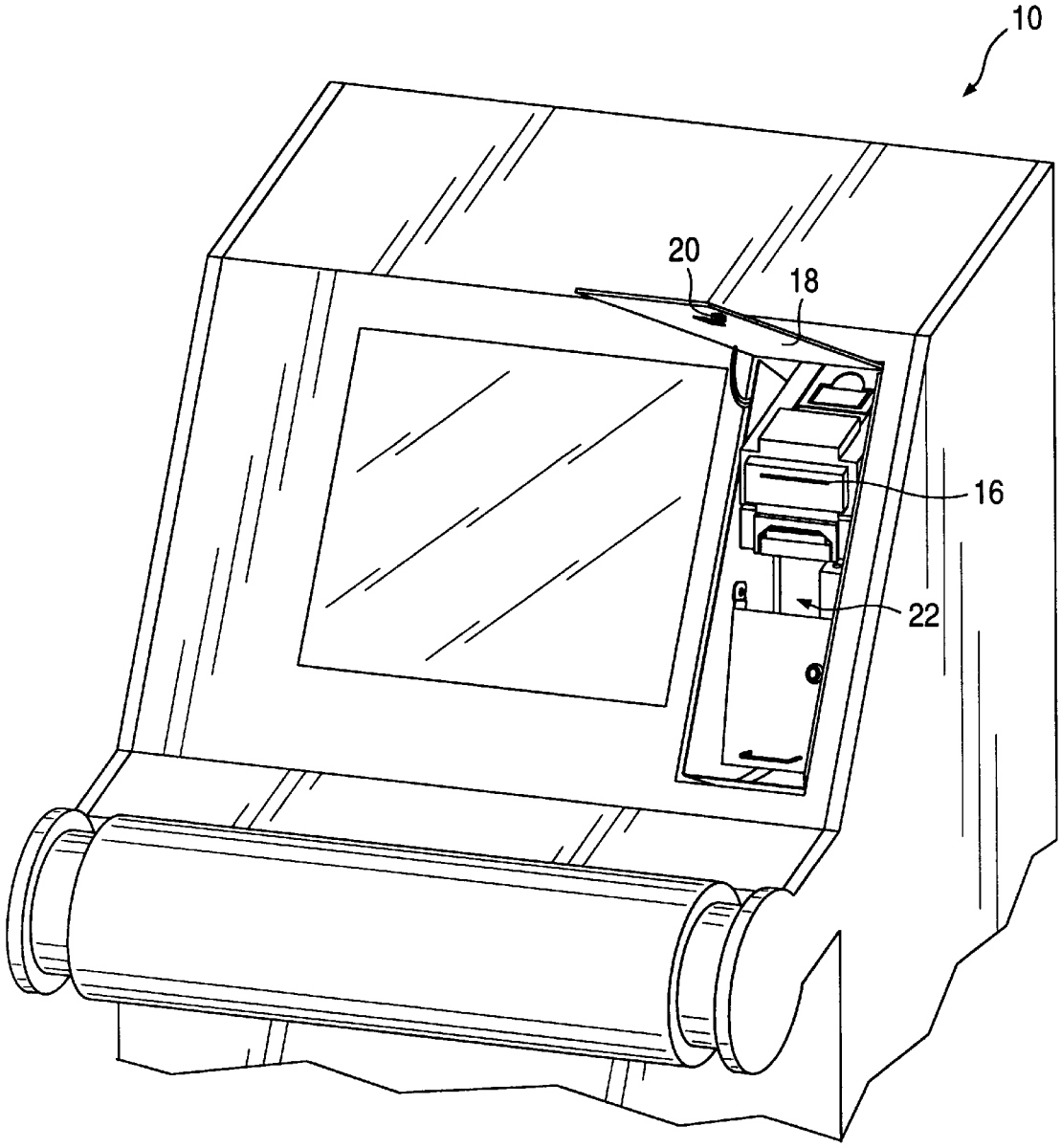
FIG. 2 illustrates the machine of FIG. 1 with the console door open.

The cash box containing the deposited bills is accessed by opening a console door 18 with a key. Console door lock 20 is shown. FIG. 2 illustrates the machine of FIG. 1 with the console door 18 opened to gain access to the cash box assembly 22.

Figure 3:
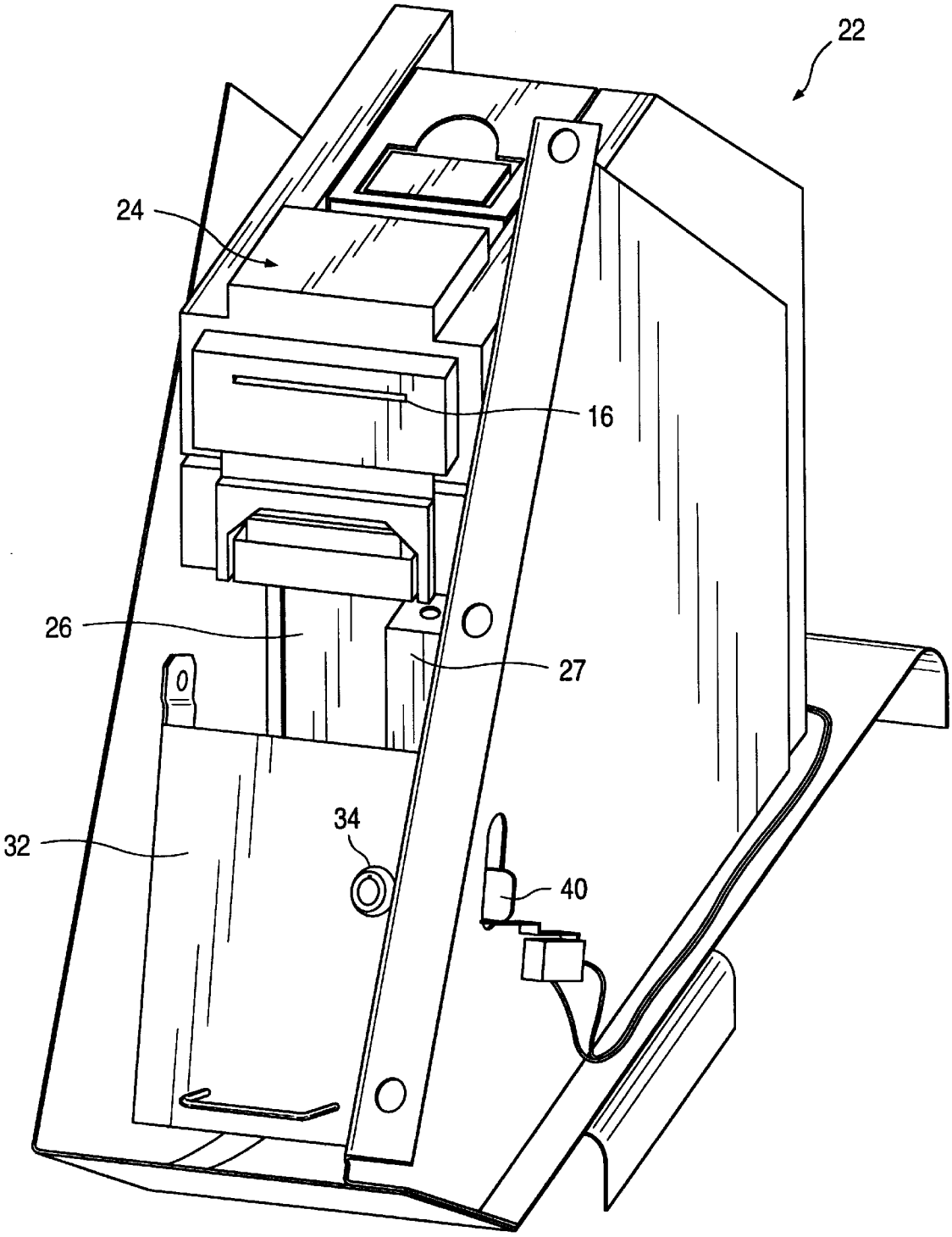
FIG. 3 is a perspective view of the entire cash box assembly, including bill validator, removed from the gaming machine with the inner door locked.

FIG. 3 is a perspective view of the cash box assembly 22, including the bill validator 24, removed from the machine 10 to better illustrate the assembly.

The bill validator 24 forwards a bill, first in a horizontal direction, and then in a vertical direction down into an opening in the cash box 26. The cash box includes gears, rollers, and other mechanisms which then place the bill on a spring-loaded stack of previously deposited bills, to be discussed in detail later. The cash box 26 is releasably locked into the position shown in FIG. 3, with the cash box 26 pushed to the back of the assembly 22. A cash box handle 27 is shown.

An electrical switch 28 (shown in FIG. 8) located at the back of the cash box assembly 22 has an actuator 30 which is tripped when the cash box 26 is pushed to the rear of the assembly 22 so as to electrically indicate to the machine that the cash box 26 has been properly inserted.

Figure 4A:
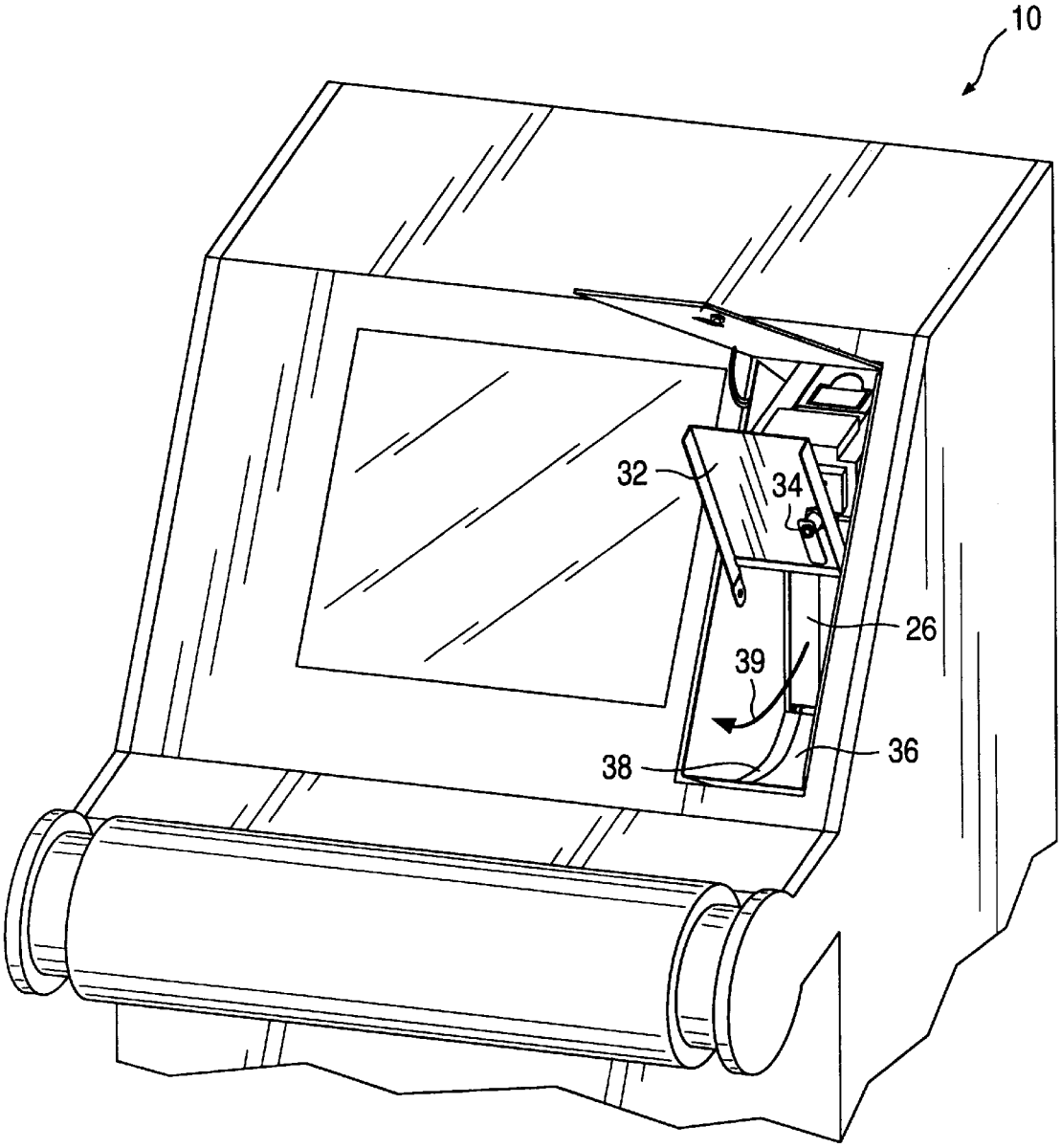
FIG. 4A illustrates the machine of FIG. 2 with the inner door opened to allow access to the cash box.
Figure 4B:
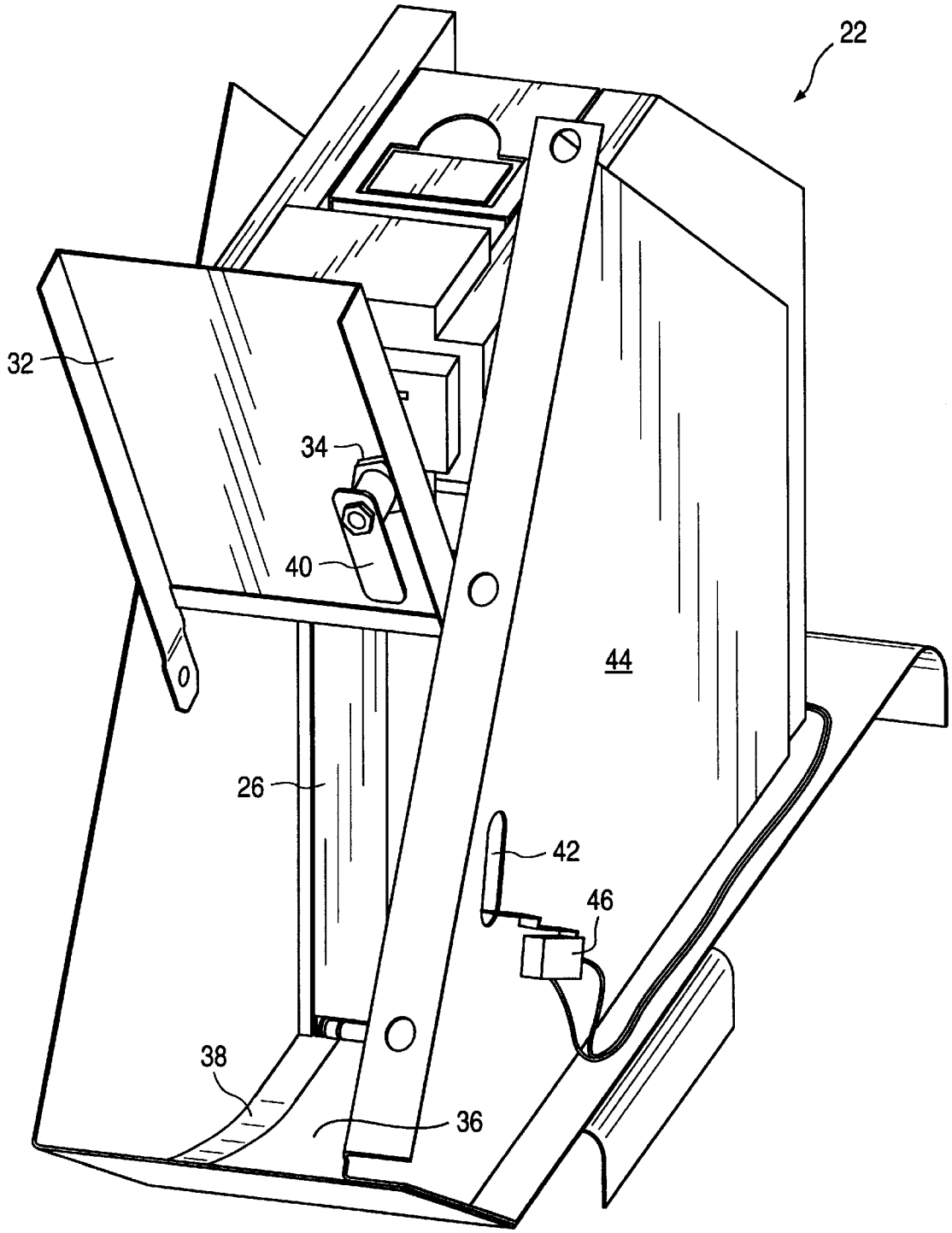
FIG. 4B illustrates in greater detail the cash box assembly of FIG. 3 with the inner door opened to allow access to the cash box.

Referring back to FIG. 3, an inner door 32 is opened by a key to allow the attendant to gain access to the cash box 26. Inner door lock 34 is shown. FIGS. 4A and 4B illustrate the assembly of FIG. 3 with the inner door 32 opened.

The assembly 22 includes an arcuate chute 36 (FIG. 4B) defining a path for the cash box's removal and insertion. The bottom of the cash box 26 slides along a pair of arcuate runners 38 (only the left side runner is shown) when being inserted or removed.

FIG. 4A illustrates the path 39 of the cash box 26 as the cash box is pulled by its handle 27, where the path of the cash box is determined by the arcuate runners 38 along which the cash box 26 slides.

The lock 34 on the inner door 32, when rotated by a key, rotates an arm 40 which, not only moves the arm out of a slot 42 (FIG. 3) in the right wall 44 of the assembly 22 to release the door 32, but activates a switch 46 that signals to the machine 10 that the inner door 32 is opened. If the inner door 32 is opened or the cash box 26 is not inserted properly, the gaming machine 10 will not operate, and a display 48 (FIG. 1) on the console 14 indicates the problem. Even after the inner door 32 is closed, as shown in FIG. 3, the attendant may easily fit his hand between the top of the door 32 and the bill validator 24 to push the cash box 26 into position, if the cash box 26 was not previously correctly positioned.

Figure 5:
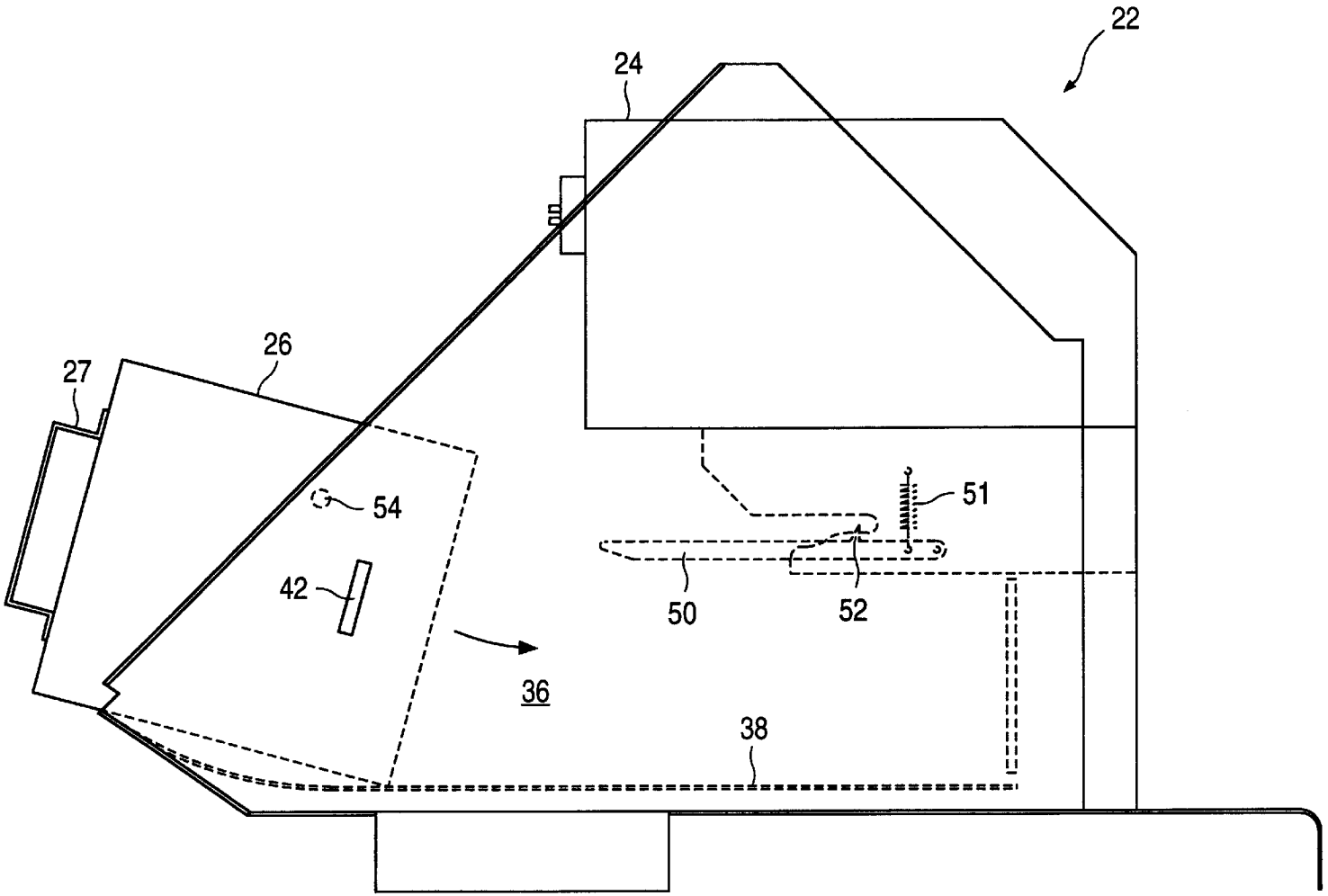
FIG. 5 is a partially transparent side view of the assembly illustrating the cash box being pushed into the assembly along the arcuate path while being supported by a guide runner.
Figure 6:
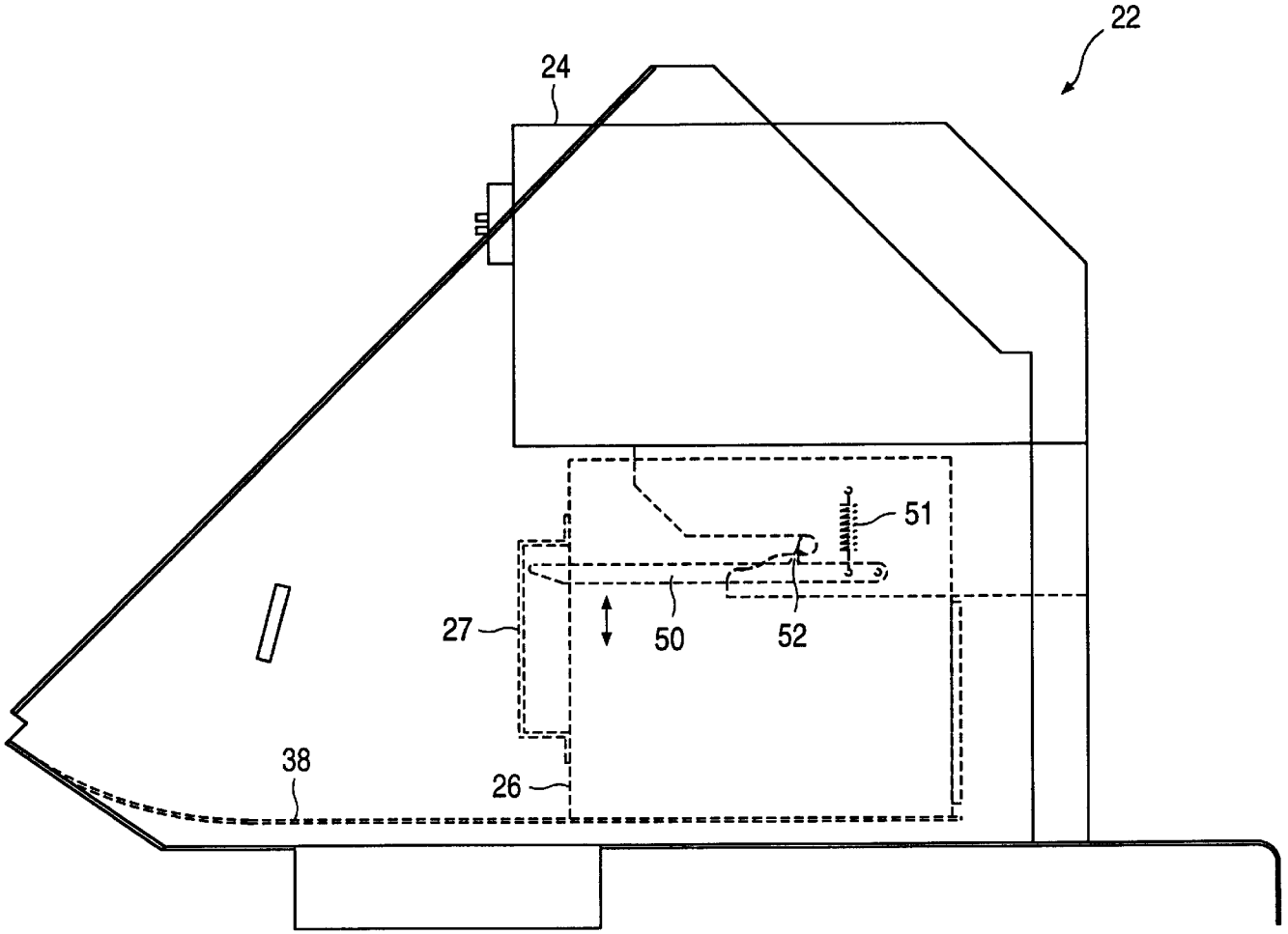
FIG. 6 illustrates the cash box fully inserted into the assembly.

FIG. 5 shows the inside of the arcuate chute 36, illustrating a release lever 50 for the cash box 26. The release lever 50 is spring-loaded by spring 51 to be urged upward and includes a bump 52 at its rearward end. The cash box 26 has a pin 54 that slides over bump 52, pushing lever 50 downward. After the pin 54 has slid past the bump 52, the lever 50 moves upward to latch the cash box 26 into position, as shown in FIG. 6. As the attendant reaches into the chute 36 and grabs the cash box handle 27, the attendant, with a thumb or finger, also presses down on the spring-loaded lever 50 to release the pin 54 to allow the cash box 26 to then be pulled forward.

Gears 55 (FIG. 8) at the back of the chute 36 are rotated by a motor and mechanism which also rotate the rollers 56 within the bill validator 24 for forwarding the bill along its path. These gears 54 mesh with exposed gears 58 (FIG. 7) in the cash box 26, which drive rollers and other mechanisms in the cash box 26 to deposit the bill on the top of a stack of previously deposited bills.

Figure 7:
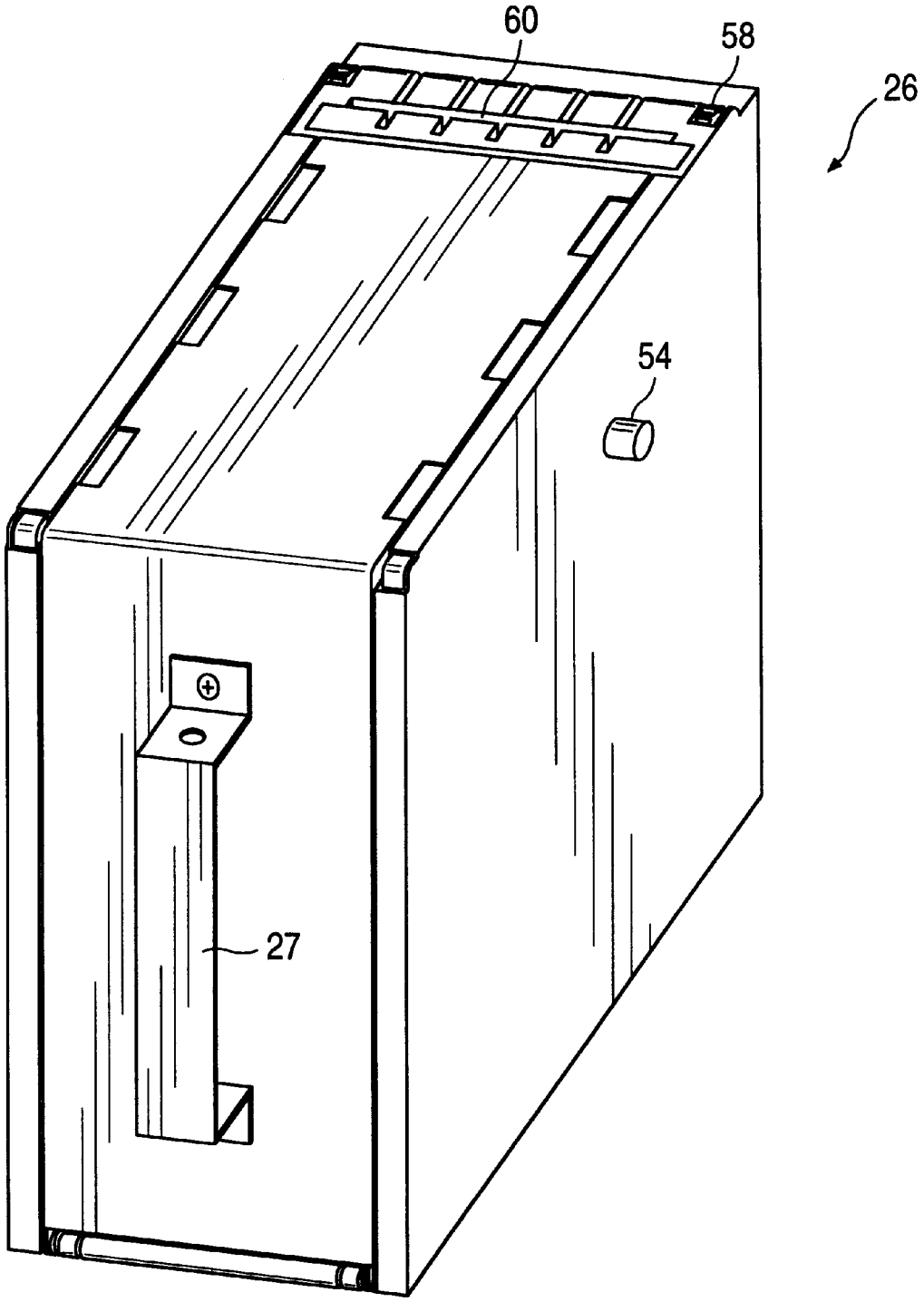
FIG. 7 is a perspective view of the cash box removed from the assembly.

FIG. 7 illustrates the cash box 26 removed from the chute 36. The pin 54 which interacts with the spring-loaded lever 50 is shown along with a slot 59 in the top of the box 26 for receiving a bill and the gears 58 previously described.

Figure 8:
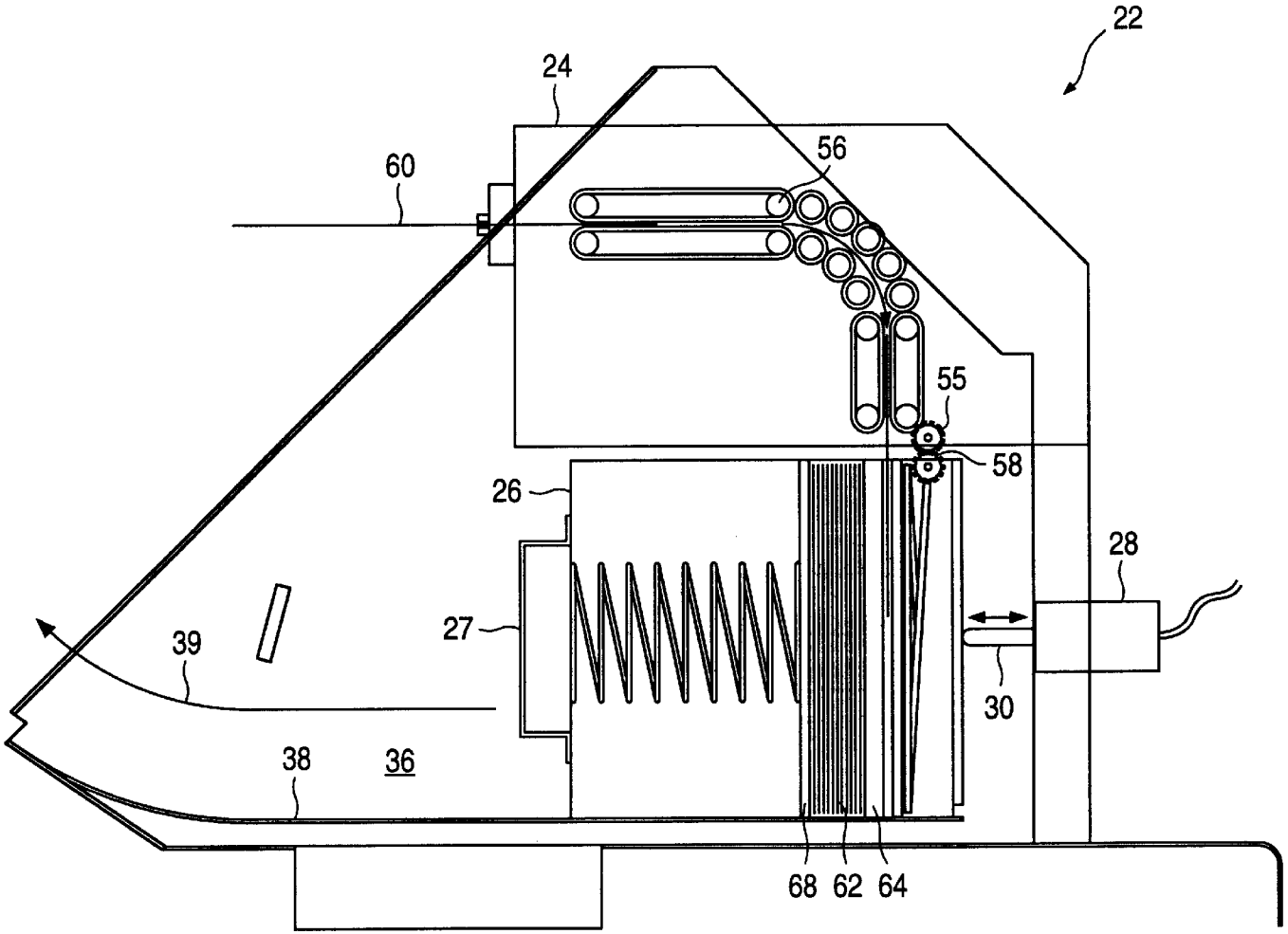
FIG. 8 illustrates the path of a bill from the bill validator into the cash box.

FIG. 8 shows the mechanism for forwarding a bill 60 into the cash box 26. Rollers 56 in the bill validator 24 portion of the assembly 22 forward the bill first horizontally, then vertically into the top slot 59 (FIG. 7) of the cash box 26. A motor (not shown) drives the rollers 56 and gears 55 in the bill validator 24. Gears 55 drive gears 58 at the top of the cash box 26.

Figure 9:
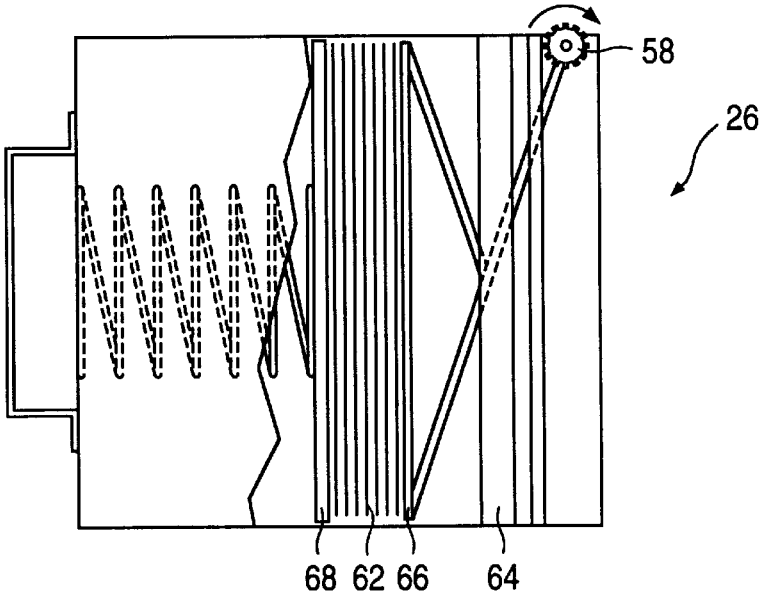
FIG. 9 is a partially transparent side view of the cash box showing its internal mechanisms.

The rotation of the gears 58 at the top of the cash box 26 forwards the bill to a temporary vertical position next to the stack of bills 62. A vertical wall 64 separates the bill from the stack of bills. The wall 64 has a central slot running the length of the bill. An additional rotation of the gears 58, as shown in FIG. 9, causes a bar 66 to push the bill through the central slot in the wall 64. The bill, when pushed through the slot, pushes the stack of bills 62 against a spring-loaded support base 68. When the bar 66 is moved away, the stack of bills 62 now push against the wall 64, additional bills may then be forwarded into the cash box 26 for the next cycle.

Figure 10:
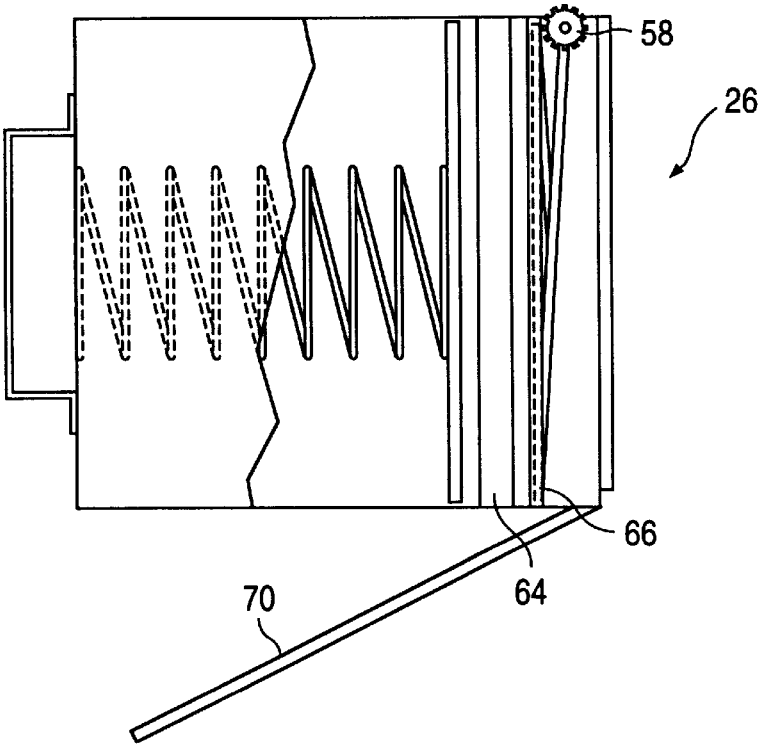
FIG. 10 is a partially transparent side view of the cash box with the cash box opened to gain access to the bills within the cash box.

FIG. 10 illustrates the cash box door 70 being open to gain access to the bills within the cash box 26. This door 70 may either have a lock or no lock, depending upon whether the operator of the casino wants to prevent the attendant from having access to the bills within the cash box 26.

The cash box assembly 22, when installed in slot machine 10, does not require an attendant to bend over to remove or insert the cash box 26 and does not require any guessing as to where the cash box 26 is located, since the opening of the chute 36 is clearly visible while the attendant is standing. The arcuate chute 36 offers little frictional resistance to the insertion and removal of the cash box 26. The assembly and cash box may be formed of any metal, such as aluminum or steel.

The cash box itself may be of any design, even the design described in the assignee's Pat. No. 5,129,330, which uses a cash box cover for latching onto the cash box and preventing access to the bills within the cash box even when the cash box is removed from the assembly.

Although the inventive cash box assembly is particularly suited for a slant-top gaming machine, the cash box assembly may be used with any bill or coin operated machine where the arcuate chute eases cash box insertion and removal.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. An apparatus comprising:

a cash box assembly for storing cash deposited into a machine, said cash box assembly comprising:

a cash box;

a support structure for said cash box to support said cash box within a cash-operated machine, said support structure having a slanted console and an arcuate chute which opens through said slanted console into which said cash box is inserted and removed, said arcuate chute guiding said cash box from an entrance opening to a final position for said cash box within said support structure, said arcuate chute forming an arcuate path opening up to said slanted console to support and guide said cash box between said entrance opening and said final position within said support structure.

2. The apparatus of claim 1 wherein in said arcuate chute includes at least one arcuate runner portion along which said cash box slides to guide said cash box into its final position within said support structure.

3. The apparatus of claim 1 wherein said support structure includes a door having a lock to block access to said cash box when said door is locked.

4. The apparatus of claim 1 wherein said support structure also includes a bill validator for receiving a bill and for forwarding said bill into said cash box.

5. The apparatus of claim 3 further comprising a gap between said door and a portion of said support structure, said gap being large enough to permit said cash box to be repositioned without opening said door.

6. The apparatus of claim 1 wherein includes a pair of spaced apart arcuate runner members which support and guide said cash box between said entrance opening and said final position within said support structure.

7. A method of placing a cash box in a cash box assembly having a support structure having a slanted console with an entrance opening therein, a final position for said cash box, and an arcuate chute connecting said entrance opening and said final position, said arcuate chute forming an arcuate path opening up to said slanted console to support and guide said cash box between said entrance opening and said final position within said support structure, the method comprising:

moving said cash box through said arcuate chute from said entrance opening to said final position on said arcuate path.

8. The method of claim 7 wherein said arcuate chute includes a pair of spaced apart arcuate runner members which support and guide said cash box between said entrance opening and said final position within said support structure and moving said cash box through said arcuate chute from said entrance opening to said final position on said arcuate runner members.

9. A method of replacing a full cash box with an empty cash box in a cash box assembly having a support structure with a slanted console and with an arcuate chute, said arcuate chute forming an arcuate path opening up to said slanted console to support and guide said cash box between said entrance opening and said final position within said support structure and a door having a lock to block access to said cash box when said door is locked, the method comprising:

unlocking said door;

removing said full cash box by moving said full cash box through said arcuate chute on said arcuate path;

placing said empty cash box in said cash box assembly by moving said empty cash box through said arcuate chute on said arcuate path; and locking said door.

10. The method of claim 9 further comprising repositioning said empty cash box after placing said empty cash box in said cash box assembly.

11. The method of claim 9 wherein said arcuate chute includes a pair of spaced apart arcuate runner members which support and guide said cash box between said entrance opening and said final position within said support structure and moving said cash box through said arcuate chute from said entrance opening to said final position on said arcuate runner members.

* * * * *